US009403617B2

(12) United States Patent
Schneider et al.

(10) Patent No.: US 9,403,617 B2
(45) Date of Patent: Aug. 2, 2016

(54) COLLAPSIBLE CONTAINERS

(71) Applicants: Steve J. Schneider, Decatur, GA (US); Mark Wayne Britt, Monticello, GA (US); Michael Eugene Socha, Lagrange, GA (US)

(72) Inventors: Steve J. Schneider, Decatur, GA (US); Mark Wayne Britt, Monticello, GA (US); Michael Eugene Socha, Lagrange, GA (US)

( * ) Notice: Subject to any disclaimer, the term of this patent is extended or adjusted under 35 U.S.C. 154(b) by 30 days.

(21) Appl. No.: 14/288,601

(22) Filed: May 28, 2014

(65) Prior Publication Data

US 2015/0344170 A1 Dec. 3, 2015

(51) Int. Cl.

| | |
|---|---|
| ***B65D 5/36*** | (2006.01) |
| ***B65D 25/28*** | (2006.01) |
| ***B65D 43/14*** | (2006.01) |
| ***B65D 43/22*** | (2006.01) |
| ***B65D 37/00*** | (2006.01) |
| ***A45C 5/00*** | (2006.01) |
| ***A45C 5/02*** | (2006.01) |
| ***A45C 7/00*** | (2006.01) |
| ***A45C 13/30*** | (2006.01) |

(52) U.S. Cl.

CPC ... *B65D 5/36* (2013.01); *A45C 5/00* (2013.01); *A45C 5/02* (2013.01); *A45C 7/0036* (2013.01); *A45C 13/30* (2013.01); *B65D 25/282* (2013.01); *B65D 25/2826* (2013.01); *B65D 37/00* (2013.01); *B65D 43/14* (2013.01); *B65D 43/22* (2013.01); *B65D 2525/283* (2013.01); *Y10T 29/49828* (2015.01)

(58) Field of Classification Search

CPC .. A45C 7/0036; A45C 7/0022; A45C 7/0018; A45C 7/00; A45C 7/0059; A45C 7/0063; A45C 7/0068

USPC ..... 220/9.1, 9.4

See application file for complete search history.

(56) References Cited

U.S. PATENT DOCUMENTS

| | | | | |
|---|---|---|---|---|
| 5,413,199 | A | 5/1995 | Clement | |
| 6,612,453 | B2 * | 9/2003 | Joo-Tai | 220/9.2 |
| 7,861,880 | B2 | 1/2011 | Britt et al. | |
| 2011/0174811 | A1 | 7/2011 | Sabounjian | |
| 2013/0075214 | A1 | 3/2013 | Chen et al. | |

OTHER PUBLICATIONS

PCT Search Report and Written Opinion in co-pending, related PCT Application No. PCT/US2015/32796, mailed Aug. 25, 2015.

Dump&Stor Outdoor Storage Bag. Datasheet [online]. Material Motion, 2013 [retrieved on Aug. 10, 2015]. Retrieved from the Internet: <URL: http://web.archive.org/web/20140302120636/http://www.dumpandstor.com/large-outdoor-bag>.

Dump&Stor. Video [online]. Material Motion, 2014 [retrieved on Aug. 10, 2015]. Retrieved from the Internet: <URL: https://vimeo.com/79096525>.

U.S. Pat. No. 7,861,880 File History 2007-2011.

* cited by examiner

*Primary Examiner* — Stephen Castellano

(74) *Attorney, Agent, or Firm* — Thomas | Horstemeyer, LLP

(57) ABSTRACT

Disclosed are various embodiments of containers that may be collapsible. In one embodiment, the container includes a first pliable end panel and a second pliable end panel that are attached to multiple pliable side panels. Each pliable side panel has a respective side panel support member attached thereto. The second pliable end panel includes a first closable flap. The first closable flap comprises a second closable flap.

12 Claims, 2 Drawing Sheets

COLLAPSIBLE CONTAINERS

BACKGROUND

Multiple objects may be stored in a container. A person or machinery may be used to transport the container with the objects stored therein.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure describes various containers. According to various embodiments, the container may include pliable panels that facilitate accommodating objects that may otherwise not fit into a container with rigid panels. The pliable panels and/or other portions of the container may be constructed at least in part from woven polypropylene to provide a relatively high strength container that is mildew resistant. When the container is not in use, the container may be collapsed and folded to reduce the amount of volume that is occupied by the container.

Figure 1:
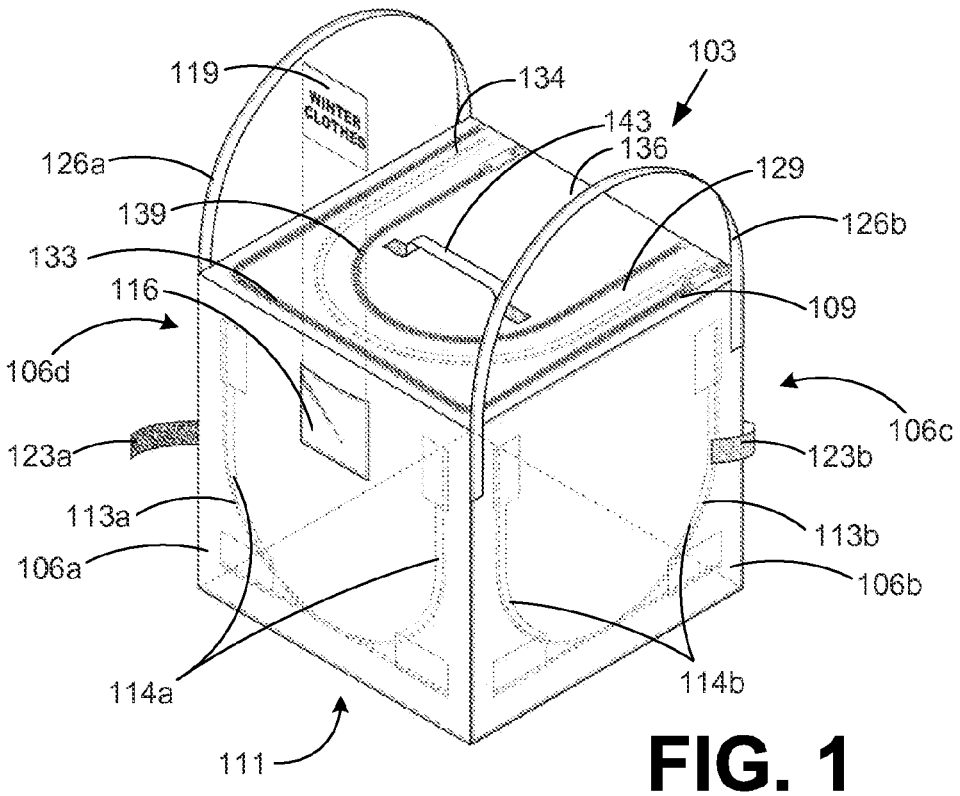
FIG. 1 is a drawing of a container according to various embodiments of the present disclosure.

With reference to FIG. 1, shown is an example of a container 103 according to various embodiments of the present disclosure. The container 103 may include multiple side panels 106*a*-106*d* that are attached and positioned between a first end panel 109 and a second end panel 111.

At least a portion of the side panels 106*a*-106*d* may be pliable. In this regard, at least a portion of the side panels 106*a*-106*d* may be flexible. By being pliable, the side panels 106*a*-106*d* may facilitate objects being placed in the container 103 that would otherwise not fit in a similar container 103 formed by side panels 106*a*-106*d* that were rigid. To provide pliability, the side panels 106*a*-106*d* may be constructed at least in part from woven polypropylene and/or any other suitable material.

One or more side panel support members 113*a*-113*d* may be attached to the respective side panels 106*a*-106*b*. It is noted that the side panel support members 113*c*-113*d* are not visible in FIG. 1. The side panel support members 113*a*-113*d* may provide structural support for the side panels 106*a*-106*d*. For example, the side panel support members 113*a*-113*d* may provide support so that the side panels 106*a*-106*d* are substantially planar when in the configuration shown in FIG. 1. To provide structural support, the side panel support members 113*a*-113*d* may be constructed at least in part from rigid materials, such as metal, plastic, wood, and/or any other suitable material. The side panel support members 113*a*-113*b* shown in FIG. 1 are embodied in the form of U-shaped rods, but the side panel support members 113*a*-113*d* may take the form of other shapes in alternative embodiments.

The side panel support members 113*a*-113*d* may be attached to the respective side panels 106*a*-106*d* in various ways. As a non-limiting example, the side panel support members 113*a*-113*d* may be attached to the side panels 106*a*-106*d* by being positioned between the side panels 106*a*-106*d* and support member attachments 114*a*-114*b* that are sewn onto the respective side panels 106*a*-106*d*. The support member attachments 114*a*-114*b* may comprise pliable materials, such as woven polypropylene and/or any other suitable material.

One or more of the side panels 106*a*-106*d* may include a pocket 116 for a label 119. In some embodiments, the pocket 116 may comprise a material that is transparent to visible light so that markings on the label 119 are visible through the pocket 116. In alternative embodiments, a user may provide markings directly on the pocket 116 using, for example but not limited to, a non-permanent ink marker.

Additionally, one or more of the side panels 106*a*-106*d* may include one or more loops (not shown) that may be slid over, for example, the forks of a forklift. The loops in some embodiments may be constructed at least in part from woven polypropylene or any other suitable material.

One or more of the side panels 106*a*-106*d* may include one or more side panel fasteners 123*a*-123*b*. The side panel fasteners 123*a*-123*b* may be used to restrict the container 103 in a collapsed and/or folded position when the container 103 is in a collapsed configuration, as will be described in further detail below. In this regard, when fastened, the side panel fasteners 123*a*-123*b* may maintain the side panels 106*a*-106*d* in position so that the container 103 remains in the collapsed configuration until the side panel fasteners 123*a*-123*b* are unfastened. According to various embodiments, the side panel fasteners 123*a*-123*b* may be embodied in the form of hook and loop fasteners, snap fasteners, tie straps, adhesive strips, and/or any other suitable component that may be used to restrict the side panels 106*a*-106*d* to a collapsed position when the container 103 is in the collapsed configuration.

Additionally, one or more straps 126*a*-126*b* may be attached to one or more of the side panels 106*a*-106*d*. The straps 126*a*-126*b* may be held by a user or a machine to facilitate carrying the container 103. The straps 126*a*-126*b* may be constructed at least in part from woven polypropylene or any other suitable material. As shown in FIG. 1, the straps 126*a*-126*b* may be attached to edges formed between the side panels 106*a*-106*d*. In alternative embodiments, one or more straps 126*a*-126*b* may be attached to the first end panels 109 and/or the second end panel 111.

As shown in FIG. 1, the first end panel 109 may be attached to the side panels 106*a*-106*d*. In some embodiments, at least a portion of the first end panel 109 may be pliable. To provide pliability, the first end panel 109 may be constructed at least in part from woven polypropylene and/or any other suitable material.

The first end panel 109 may include a first flap 129. The first flap 129 may take the form of various shapes according to various embodiments. For example, the first flap 129 shown in FIG. 1 is rectangular. In alternative embodiments, the first flap 129 may be circular, triangular, and/or any other suitable shape. The first flap 129 shown in FIG. 1 has three ends that are separable and closable with respect to the remainder of the first end panel 109. Various types of fasteners may be used so that the first flap 129 is separable and closable with respect to the remainder of the first end panel 109. For example, FIG. 1 shows a first zipper 133 being used as a fastener so that the first flap 129 is separable and closable with respect to the remainder of the first end panel 109. In alternative embodiments, hook and loop fasteners, snap fasteners, buttons, and/or any other suitable fastener may be used so that the first flap 129 is separable and closable with respect to the remainder of the first end panel 109.

One or more flap support members 134 may be attached to the first flap 129. The flap support member 134 may provide structural support for the first end panel 109. For example, the flap support member 134 may provide support so that the first end panel 109 is substantially planar when the container 103 is in the configuration shown in FIG. 1. To provide structural support, the flap support member 134 may be constructed at least in part from a rigid material, such as metal, plastic, wood, and/or any other suitable material. The flap support member 134 shown in FIG. 1 is embodied in the form of a U-shaped rod, but the flap support member 134 may take the form of other shapes in alternative embodiments.

The first flap 129 may also include one or more second flaps 136. The second flap 136 may also take the form of various shapes according to various embodiments. For example, the second flap 136 shown in FIG. 1 takes the shape of a rectangle having a semicircular end. Alternative embodiments may be rectangular, triangular, curved, and/or any other suitable shape. At least a portion of the second flap 136 is separable and closable with respect to the remainder of the first flap 129. For example, FIG. 1 shows a second zipper 139 being used so that the second flap 136 is separable and closable with respect to the remainder of the first flap 129. In alternative embodiments, hook and loop fasteners, snap fasteners, buttons, and/or any other suitable fastener may be used so that the second flap 136 is separable and closable with respect to the remainder of the first flap 129.

As shown in FIG. 1, one or more flap handles 143 may be attached to the second flap 136. In alternative embodiments, one or more flap handles 143 may be attached to the first flap 129. The flap handle 143 may facilitate a user opening and/or closing the first flap 129 and/or the second flap 136. Additionally, the flap handle 143 may facilitate a user carrying the container 103.

As shown in FIG. 1, the second end panel 111 may also be attached to each of the side panels 106*a*-106*d*. Additionally, at least a portion of the second end panel 111 may be pliable. To provide pliability, the second end panel 111 may be constructed at least in part from woven polypropylene and/or any other suitable material. In some embodiments, no rigid support elements are attached to the second end panel 111. By not having rigid support elements attached to the second end panel 111, the second end panel 111 may facilitate the container 103 being collapsible, as will now be described.

Figure 2:
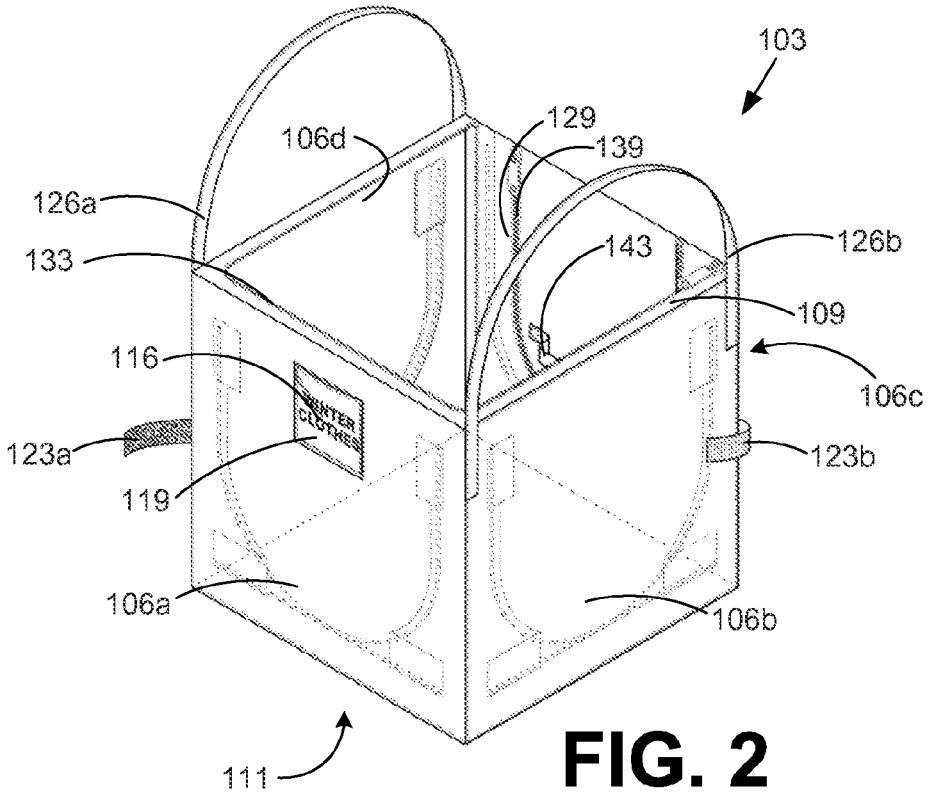
FIG. 2 is a drawing of the container of FIG. 1 with an open flap according to various embodiments of the present disclosure.

With reference to FIG. 2, shown is the container 103 with the first flap 129 opened. A user may open the first flap 129 to begin the process of collapsing the container 103. To this end, the user may unfasten the first zipper 133, and the first flap 129 may be positioned within the space formed between the side panels 106*a*-106*d*, as shown in FIG. 1.

Figure 3:
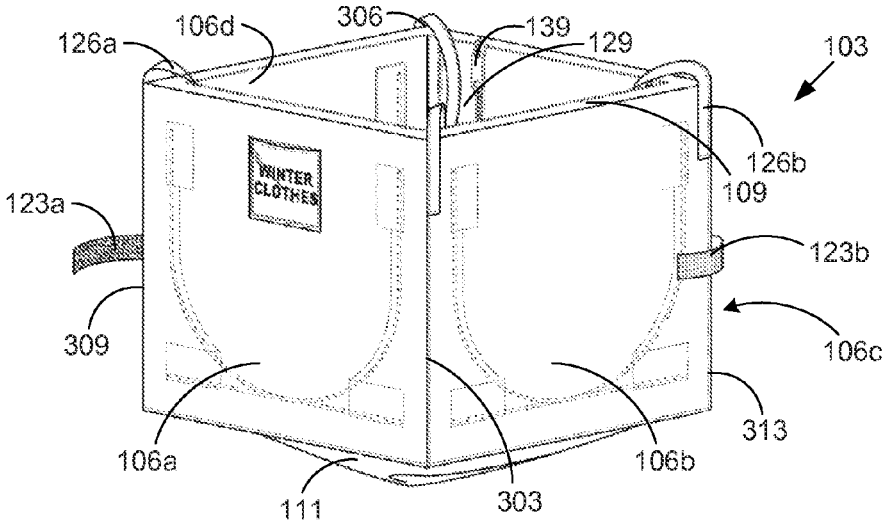
FIG. 3 is a drawing of the container of FIG. 1 being collapsed according to various embodiments of the present disclosure.

With reference to FIG. 3, shown is the container 103 being collapsed according to various embodiments of the present disclosure. To cause the container 103 to be in the configuration shown in FIG. 3, a user may press against the edge 303 formed between the side panels 106*a*-106*b* and the edge 306 formed between the side panels 106*c*-106*d* so that the edge 303 moves closer to the edge 306. This maneuver causes the side panel 106*a* and/or the side panel 106*d* to be rotated about the edge 309 formed between the side panel 106*a* and the side panel 106*d*. As a result, the angle formed between the side panel 106*a* and the side panel 106*d* is reduced. Similarly, the side panel 106*b* and/or the side panel 106*c* to be rotated about the edge 313 formed between the side panel 106*b* and the side panel 106*c*. As a result, the angle formed between the side panel 106*b* and the side panel 106*c* is reduced. When the container 103 has been collapsed, the edge 303 formed between the side panel 106*a* and the side panel 106*b* may be positioned adjacent to the edge 306 formed between the side panel 106*c* and the side panel 106*d*.

As shown in FIG. 3, the second end panel 111, which may not have any support members attached thereto, may crumple or fold as the edge 303 is brought closer to the edge 306. Thus, the pliability of the second end panel 111 may facilitate the container 103 being collapsible. A user may also position the straps 126*a*-126*b* in the space formed between the side panels 106*a*-106*c* during the collapsing process.

Figure 4:
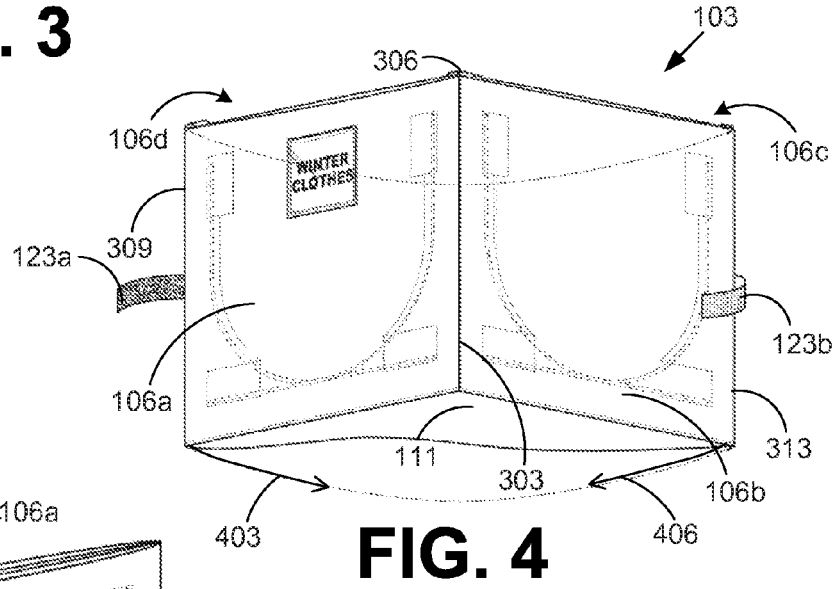
FIG. 4 is a drawing of the container of FIG. 1 being folded according to various embodiments of the present disclosure.

With reference to FIG. 4, shown is the container 103 being folded according to various embodiments of the present disclosure. As shown in FIG. 4, the container 103 has been collapsed so that the side panel 106*a* is substantially flat with respect to the side panel 106*d* and so that the side panel 106*b* is substantially flat with respect to the side panel 106*c*. Additionally, the edge 303 is positioned adjacent to the edge 306, as shown in FIG. 4.

A user may fold the container 103 by rotating the side panels 106*a*-106*b* about the edge 303 while simultaneously rotating the side panels 106*c*-106*d* about the edge 306 in the directions indicated by the arrows 403 and 406. This maneuver brings the edge 309 closer to the edge 313.

Figure 5:
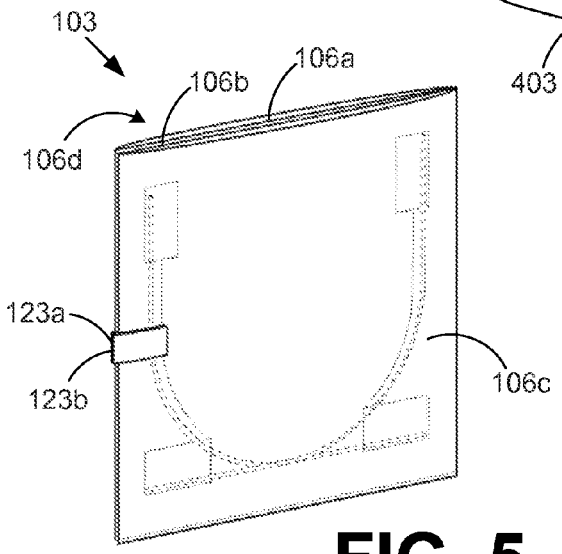
FIG. 5 is a drawing of the container of FIG. 1 in a collapsed configuration according to various embodiments of the present disclosure.

With reference to FIG. 5, shown is the container 103 in a collapsed configuration after the container 103 has been folded. As shown, the side panels 106*a*-106*d* are substantially flat with respect to each other. As such, the volume occupied by the container 103 is less than the volume that a non-collapsible container would occupy.

A user may also fasten the side panel fasteners 123*a*-123*b*. When fastened, the side panel fasteners 123*a*-123*b* may be used to restrict the side panels 106*a*-106*d* to be in the position shown in FIG. 5. In this regard, the side panel fasteners 123*a*-123*b* may maintain the side panels 106*a*-106*d* in the position shown in FIG. 5 so that the container 103 remains in the collapsed configuration until the side panel fasteners 123*a*-123 are unfastened.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A collapsible container, comprising:

a first pliable end panel;

a plurality of pliable side panels attached to the first pliable end panel, wherein each of the plurality of pliable side panels has a respective side panel support member attached thereto, wherein each side panel support member is embodied in a form of a continuous U-shaped rod, wherein each side panel support member comprises a first end and a second end, and wherein the first end and the second end of each side panel support member are displaced a substantially equal distance from an edge of one of the plurality of pliable side panels; and a second pliable end panel attached to the plurality of pliable side panels, wherein the second pliable end panel comprises a first closable flap, wherein a flap support member is attached to the first closable flap and embodied in the form of the continuous U-shaped rod, wherein the first closable flap comprises a second closable flap, wherein the second closable flap comprises a flap handle, and wherein each side panel support member remains attached to a corresponding one of the plurality of pliable side panels when the collapsible container is in a collapsed position.

2. The collapsible container of claim 1, wherein the first pliable end panel, the plurality of side panels, and the second pliable end panel are constructed of at least a woven polypropylene.

3. The collapsible container of claim 1, further comprising a strap attached to at least one of the plurality of pliable side panels.

4. The collapsible container of claim 1, wherein the second pliable end panel further comprises a zipper to close the first closable flap.

5. The collapsible container of claim 1, wherein the second pliable end panel further comprises a zipper to close the second closable flap.

6. The collapsible container of claim 1, further comprising a handle attached to at least one of the plurality of pliable side panels.

7. The collapsible container of claim 1, further comprising means for restricting the plurality of pliable side panels in the collapsed position.

8. A container, comprising:

a first pliable end panel;

plurality of pliable side panels attached to the first pliable end pane, wherein each of the plurality of pliable side panels has a respective side panel support member attached thereto, wherein each side panel support member is embodied in a form of a continuous U-shaped rod, wherein each side panel support member comprises a first end and a second end, and wherein the first end and the second end of each side panel support member are displaced a substantially equal distance from an edge of one of the plurality of pliable side panels; and a second pliable end panel attached to the plurality of pliable side panels, wherein the second pliable end panel comprises a first closable flap, wherein the first closable flap comprises a second closable flap, wherein a flap support member is attached to the first closable flap and embodied in a form of a continuous U-shaped rod, and wherein each side panel support member remains attached to a corresponding one of the plurality of pliable side panels when the container is in a collapsed position.

9. The container of claim 8, wherein the second closable flap comprises a flap handle.

10. The container of claim 8, where the first pliable end panel, the plurality of side panels, and the second pliable end panel are constructed of at least a woven polypropylene.

11. The container of claim 8, wherein the second pliable end panel further comprises a first zipper to close the first closable flap.

12. The container of claim 11, wherein the second pliable end panel further comprises a second zipper to close the second closable flap.

* * * * *